United States Patent [19]

Billings et al.

[11] Patent Number: 4,494,166

[45] Date of Patent: Jan. 15, 1985

[54] PRINTING MACHINE WITH STATIC ELIMINATION SYSTEM

[75] Inventors: Philip A. Billings, Fairport; William S. Franks, Jr., Penfield, both of N.Y.

[73] Assignee: Xerox Corporation, Stamford, Conn.

[21] Appl. No.: 421,000

[22] Filed: Sep. 21, 1982

[51] Int. Cl.[3] ..... H05F 3/00

[52] U.S. Cl. ..... 361/214; 361/221

[58] Field of Search ..... 361/212, 214, 220, 221, 361/225, 213

[56] References Cited

U.S. PATENT DOCUMENTS

| | | | |
|---|---|---|---|
| 2,449,972 | 9/1948 | Beach | 175/264 |
| 3,470,417 | 9/1969 | Gibbons | 361/225 X |
| 3,578,970 | 5/1971 | Michaud | 361/225 X |
| 3,757,164 | 9/1973 | Binkowski | 317/2 R |

FOREIGN PATENT DOCUMENTS

| | | | |
|---|---|---|---|
| 1085776 | 2/1955 | France | 361/221 |

*Primary Examiner*—Harry E. Moose, Jr.
*Attorney, Agent, or Firm*—William A. Henry, II

[57] ABSTRACT

A printing machine includes at least two grounded carbon fiber brush static eliminators mounted in a molded plastic baffle assembly that optimizes discharge characteristics. The eliminators are mounted such that one brush contacts sheets moving through the machine while the other brush remains out of contact with the sheets in order to minimize fluctuations in static reduction over machine life.

1 Claim, 3 Drawing Figures

PRINTING MACHINE WITH STATIC ELIMINATION SYSTEM

This invention relates to a printing machine for making copies of page images, and more particularly to a static elimination system for reducing static electrical charges on the surface of sheets moving through the machine.

Static electrical charges are generated on a dielectric web or sheet material by contact with charged rollers or webs or by frictional contact with stationary guide surfaces necessary to transport it through a handling apparatus. The build-up of these charges can be a severe problem. Such static electrical charges can cause the conveyed material to be attracted to other like material or to portions of the handling apparatus, thus interferring with proper functioning of the apparatus. Additionally, the static electrical charges present on a sheet or web may attract dust or may present a dangerous annoyance to operators. Thus, many types of devices have been used to reduce or remove static electricity on a dielectric web or sheet material.

For example, inductive static eliminators are known that either contact sheets directly or remain out of contact with the sheets as disclosed in U.S. Pat. No. 3,757,164. The problem with using out of contact inductive static eliminators is that efficiency is lost by the use of this method and cost of the eliminator device increases since with less efficiency more eliminators are required to provide the desired static discharge. Inductive eliminators are known to be more efficient in a contacting mode, i.e., lower charge per sheet out of a machine than charge per sheet in the machine. However, in a contacting mode, the eliminator fibers are subject to bending and impart stresses, may fracture, wear or pull out, and may be contaminated by sheet dust, toner and fuser oil. This combination has proven to degrade eliminator performance when stainless steel fibers are employed.

The present invention overcomes the above-mentioned problems by employing a printing machine that includes an arrangement of at least two inductive static eliminators, one in a non-contacting position in relation to sheets passing through the machine and the other in a sheet contacting position such that static elimination is optimized while minimizing efficiency degradation and fiber loss and damage over the machine life.

A preferred feature of the present invention is to provide a device for neutralizing static electrical charge on sheets passing through a paper path and includes placing at least a first and second inductive static eliminator means within the paper path. The first inductive static eliminator means is positioned in out of contact relation with sheets that traverse the paper path, while the second inductive static eliminator means is positioned to contact passing sheets. The first inductive static eliminator means is adapted to uniformly reduce the major portion of static electrical charge on the sheets while the second inductive static eliminator means is adapted to reduce the remaining electrical charge to at least a predetermined minimum level.

Another preferred feature of the present invention is to provide a mounting means for the inductive static eliminator means that increases paper handling and electrostatic discharge efficiencies. The mounting means includes a plastic baffle assembly having ribs that allow a minimum of material other than charged sheets within a predetermined threshold distance of the inductive static eliminator means while permitting a constrained, low drag paper path.

Other features and aspects of the present invention will be apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
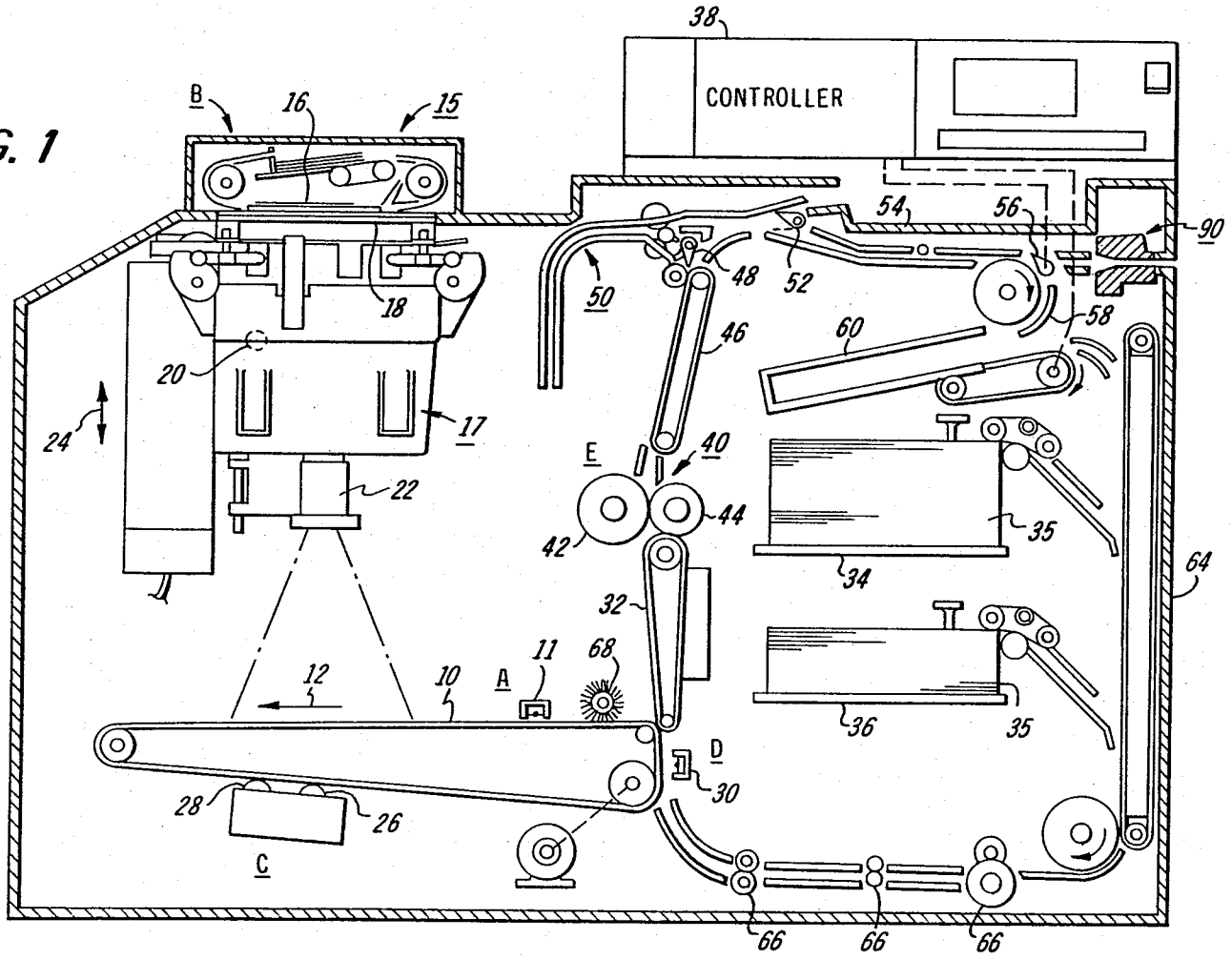
FIG. 1 is a schematic elevational view showing an electrophotographic printing machine employing the features of the present invention therein.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the static eliminator mounting apparatus of the present invention therein.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotographic printing machine employs a belt 10 having a photoconductive surface thereon. Preferably, the photoconductive surface is made from a selenium alloy. Belt 10 moves in the direction of arrow 12 to advance successive portions of the photoconductive surface through the various processing stations disposed about the path of movement thereof.

Initially, a portion of the photoconductive surface passes through charging station A. At charging station A, a corona generating device, indicated generally by the reference numeral 14, charges the photoconductive surface to a relatively high substantially uniform potential.

Next, the charged portion of the photoconductive surface is advanced through imaging station B. At imaging station B, a document handling unit, indicated generally by the reference numeral 15, positions original document 16 facedown over exposure system 17. The exposure system, indicated generally by reference numeral 17 includes lamp 20 which illuminates document 16 positioned on transparent platen 18. The light rays reflected from document 16 are transmitted through lens 22. Lens 22 focuses the light image of original document 16 onto the charged portion of the photoconductive surface of belt 10 to selectively dissipate the charge thereof. This records an electrostatic latent image on the photoconductive surface which corresponds to the informational areas contained within the original document. Thereafter, belt 10 advances the electrostatic latent image recorded on the photoconductive surface to development station C. Platen 18 is mounted movably and arranged to move in the direction of arrows 24 to adjust the magnification of the original document being reproduced. Lens 22 moves in synchronism therewith so as to focus the light image of original document 16 onto the charged portions of the photoconductive surface of belt 10.

Document handling unit 15 sequentially feeds documents from a stack of documents placed by the operator in a normal forward collated order in a document stacking and holding tray. The documents are fed from the holding tray, in seriatim, to platen 18. The document handling unit recirculates documents back to the stack supported on the tray. Preferably, the document handling unit is adapted to serially sequentially feed the documents, which may be of various sizes and weights of paper or plastic containing information to be copied. The size of the original document disposed in the holding tray and the size of the copy sheet are measured.

While a document handling unit has been described, one skilled in the art will appreciate that the size of the original document may be measured at the platen rather than in the document handling unit. This is required for a printing machine which does not include a document handling unit.

With continued reference to FIG. 1, at development station C, a pair of magnetic brush developer rollers, indicated generally by the reference numerals 26 and 28, advance a developer material into contact with the electrostatic latent image. The latent image attracts toner particles from the carrier granules if the developer material to form a toner powder image on the photoconductive surface of belt 10.

After the electrostatic latent image recorded on the photoconductive surface of belt 10 is developed, belt 10 advances the toner powder image to transfer station D. At transfer station D, a copy sheet is moved into contact with the toner powder image. Transfer station D includes a corona generating device 30 which sprays ions onto the backside of the copy sheet. This attracts the toner powder image from the photoconductive surface of belt 10 to the sheet. After transfer, conveyor 32 advances the sheet to fusing station E.

The copy sheets are fed from a selected one of trays 34 or 36 to transfer station D. Each of these trays sense the size of the copy sheet and send an electrical signal indicative thereof to a microprocessor within controller 38. Similarly, the holding tray of document handling unit 15 includes switches thereon which detect the size of the original document and generate an electrical signal indicative thereof which is transmitted also to a microprocessor controller 38.

Fusing station E includes a fuser assembly, indicated generally by the reference numeral 40, which permanently affixes the transferred powder image to the copy sheet. Preferably, fuser assembly 40 includes a heated fuser roller 42 and backup roller 44. The sheet passes between fuser roller 42 and backup roller 44 with the powder image contacting fuser roller 42. In this manner, the powder image is permanently affixed to the sheet.

After fusing, conveyor 46 transports the sheets to gate 48 which functions as an inverter selector. Depending upon the position of gate 48, the copy sheets will either be deflected into a sheet inverter 50 or bypass sheet inverter 50 and be fed directly onto a second decision gate 52. Thus, copy sheets which bypass inverter 50 turn a 90° corner in the sheet path before reaching gate 52. Gate 48 directs the sheets into a face up orientation so that the imaged side which has been transferred and fused is face up. If inverter path 50 is selected, the opposite is true, i.e., the last printed face is facedown. Second decision gate 52 deflects the sheet into output tray 54 or deflects the sheet into a transport path which carries it on without inversion to a third decision gate 56. Gate 56 either passes the sheets directly on without inversion into static eliminator means 90 and onward to the output path of the copier, or deflects the sheets into a duplex inverter roll transport 58. Inverting transport 58 inverts and stacks the sheets to be duplexed in a duplex tray 60 when gate 56 so directs. Duplex tray 60 provides intermediate or buffer storage for those sheets which have been printed on one side and on which an image will be subsequently printed on the side opposed thereto, i.e., the copy sheets being duplexed. Due to the sheet inverting by rollers 58, these buffer set sheets are stacked in duplex tray 60 facedown. They are stacked in duplex tray 60 on top of one another in the order in which they are copied.

In order to complete duplex copying, the previously simplexed sheets in tray 60 are fed seriatim by bottom feeder 62 back to transfer station D for transfer of the toner powder image to the opposed side of the sheet. Conveyers 64 and 66 advance the sheet along a path which produces an inversion thereof. However, inasmuch as the bottommost sheet is fed from duplex tray 60, the proper or clean side of the copy sheet is positioned in contact with belt 10 at transfer station D so that the toner powder image thereon is transferred thereto. The duplex sheets are then fed through the same path as the previously simplexed sheets to be stacked in tray 54 for subsequent removal by the printing machine operator.

Returning now to the operation of the printing machine, invariably after the copy sheet is separated from the photoconductive surface of belt 10, some residual particles remain adhering to belt 10. These residual particles are removed from the photoconductive surface thereof at cleaning station F. Cleaning station F includes a rotatably mounted fibrous brush 68 in contact with the photoconductive surface of belt 10. These particles are cleaned from the photoconductive surface of belt 10 by the rotation of brush 68 in contact therewith. Subsequent to cleaning, a discharge lamp (not shown) floods the photoconductive surface with light to dissipate any residual electrostatic charge remaining thereon prior to the charging thereof for the next successive imaging cycle.

Figure 2:
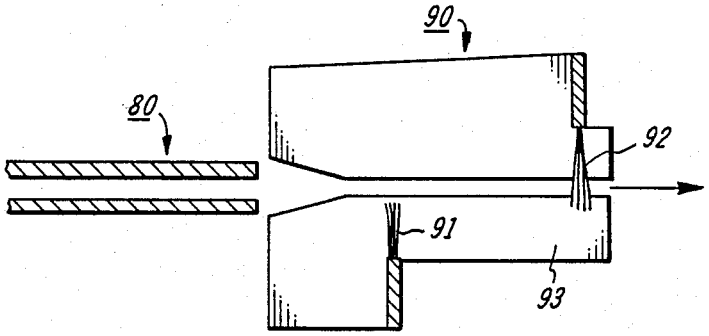
FIG. 2 is a schematic elevational view depicting the inductive static eliminator of the present invention used in the FIG. 1 printing machine.

In accordance with the present invention, as more specifically shown in FIG. 2 an inductive static eliminator means 90 is disclosed as comprising at least two grounded carbon fiber brushes 91 and 92 mounted in a molded plastic baffle assembly 93 that optimizes discharge characteristics and paper handling. Carbon fiber brushes have proven to be more consistent in reducing electrostatic charge over machine life than stainless steel fibers and are less susceptible to wear when used in a sheet contacting mode. Baffle mounting assembly 93 includes ribs 94 that allow, for other than sheets passing thereover, a minimum of material in the vicinity of the brush tips which is highly desired for uniform discharge while permitting a constrained, low drag paper path.

As expected, inductive static eliminators would be more effective if both brushes 91 and 92 contacted sheets entering static eliminator means 90 from paper path channel means 80. However, this mode of operation creates efficiency problems since the brush fibers are subjected to bending and impact stresses, fracture, wear and may be contaiminated by paper dust, developing materials used in the machine and remnants of fuser oil from the fused copy sheets. This combination of occurrences degrade static eliminator performances over too short a period of time. As a solution, the present invention provides a non-contating eliminator brush 91 followed by a sheet contacting brush 92. This combination minimizes fluctuation in static reduction over machine life. The first brush, located 0.5 to 1.0 mm below the paper path, reduces the static charge sufficiently so that the second contacting brush, even if contaminated by paper, dust, fuser oil, etc., will still dissipate the remaining charge to at least a predetermined minimum level, e.g., 20 nanocoulombs. The first out of sheet contact brush 91 is not subjected to nearly the same contamination as the contacting brush 92 and as a result exhibits minimal performance degradation.

Figure 3:
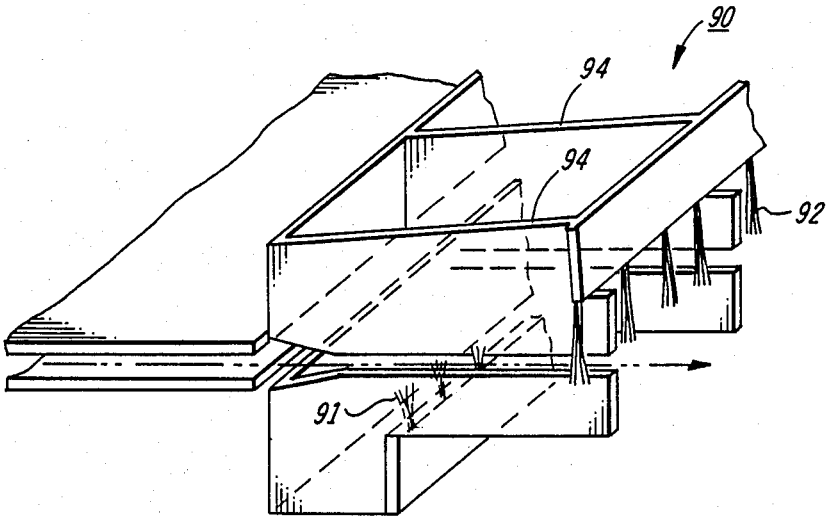
FIG. 3 is a partial schematic perspective view illustrating the support for the inductive static eliminators of FIG. 2.

Since inductive eliminators will decrease in efficiency as material other than the charged surface itself is brought into proximity with the fiber tips the area and materials around the tips have a critical bearing on eliminator performance. In FIG. 3 brush mounting assembly 90 is shown that maintains the brushes the required distances away from other materials by containing the brushes in molded plastic baffles that allow optimum paper handling while removing the bulk of extraneous material from the vicinity of the fiber tips, thereby insuring optional discharge characteristics.

In conclusion, it should now be apparent that an improved inductive static eliminator system has been disclosed that comprises at least two grounded carbon fiber brushes mounted in a molded plastic baffle assembly. The first brush that a sheet encounters is positioned to remain out of contact with the sheet while a second brush located downstream from the first brush is positioned by the assembly to contact the sheet. This non-contact/contact brush configuration minimizes fluctuations in static reduction over machine life.

What is claimed is:

1. A printing machine for producing copies from page images, comprising in combination:

printing means for printing said page images on copy sheets;

input means for feeding copy sheets toward said printing means;

output means for receiving said copy sheets after page images have been applied thereto by said printing means;

paper path means for channeling copy sheets from said input means to said output means; and static eliminator means positioned within said paper path for discharging static electricity from sheets passing through said paper path to a predetermined level, said static eliminator means including at least first and second carbon fiber brushes with said first carbon fiber brush located in a noncontacting position below the sheets and said second carbon fiber brush located above the sheets in a contacting position downstream from said first carbon brush, and wherein said first and second carbon fiber brushes are mounted in a plastic baffle assembly having a major portion of its area open with respect to sheets passing therethrough and ribs that serve as the sole support for the sheets, said first and second carbon fiber brushes having a major portion of their fibers positioned within the open area and between the ribs of said baffle assembly.

* * * * *